United States Patent [19]

Schwalb

[11] Patent Number: 4,694,669

[45] Date of Patent: Sep. 22, 1987

[54] DOOR LOCK STRUCTURE

[75] Inventor: Horst Schwalb, Ontario, Canada

[73] Assignee: Dynaflair Corporation Canada Inc., Pointe Claire, Canada

[21] Appl. No.: 885,546

[22] Filed: Jul. 14, 1986

[51] Int. Cl.[4] ..... E05B 65/08; E05C 1/02

[52] U.S. Cl. ..... 70/100; 70/120; 292/179; 292/182; 292/187

[58] Field of Search ..... 70/95, 99, 100, 113, 70/118, 120, 154; 292/42, 145, 150, 152, 177, 179, 180, 182, 183, 187, 189

[56] References Cited

U.S. PATENT DOCUMENTS

| | | | |
|---|---|---|---|
| 932,330 | 8/1909 | Rotchford | 70/118 |
| 1,777,105 | 9/1930 | Perebenda | 70/118 |
| 3,082,617 | 3/1963 | Kerman | 292/179 |
| 3,545,799 | 12/1970 | Gertsfeld | 70/120 |
| 4,179,143 | 12/1979 | Shy | 292/179 |
| 4,514,996 | 5/1985 | Sjogren | 70/100 |

*Primary Examiner*—Robert L. Wolfe

[57] ABSTRACT

A door lock structure for securement in a longitudinal cavity disposed in a door vertical free edge portion or folding door edge post, or the like. The door lock structure comprises an elongated locking rod supportingly guided in the longitudinal cavity. Each rod has a locking free end extendible above an open end of the bore above a horizontal edge of the door. The rod is normally biased in a retracted position in the cavity, with the rod locking free end disposed inwardly of the horizontal door edge. An external rod displacement element is secured to the rod for displacing the rod and the locking free end outwardly of the horizontal door edge to a locking position. A bolt engaging mechanism is disposed inwardly of the door edge adjacent the rod for engaging the rod when placed in its locking position. A key-operated cam is provided on an inside surface of the door vertical free edge portion for disengaging the rod engaging mechanism from engagement with the rod.

12 Claims, 5 Drawing Figures

DOOR LOCK STRUCTURE

BACKGROUND OF INVENTION

1. Field of Invention

The present inventin relates to a door lock structure comprising one or two locking bolts displaceably engaged in a longitudinal cavity provided in a door vertical free edge portion or a folding door edge post or the like door closures and wherein the bolt is automatically held in a locked position when manually extended to a locking position and released by means of a key-operated cam which is accessible from an outer face of the edge portion of the door or door post.

2. Description of Prior Art

A multitude of door lock structures exist utilizing locking bolts. However, with accordion-type folding doors, sometimes referred to as closure screens to close off an open store front, such as in a shopping mall, the only type of lock that exists is of the latch type which is normally located at the center of the edge post. These latch-type locks either engage between edge posts when two folding screens are provided on either side of an opening, or else they will engage in a fixed vertical column provided on a side wall of the opening. A disadvantage of such latches is that they are easily opened by applying wedge pressure between the edge post and vertical column in an area adjacent the latch. Another disadvantage of these latches is that the door structures are usually not very structurally strong, and by applying wedge pressure the locked edge is pried open. A still further disadvantage of these door locks is that the lock is only operated from the outside wall of the screen structure. Because the lock cylinder is on the outside wall of the door structure, one cannot lock the door while inside the area to be closed off by the door, and the door therefore can be closed, but in an unlocked position. This does not provide adequate protection, for example, to a jewellery shop or to the people inside the enclosure.

SUMMARY OF INVENTION

It is a feature of the present invention to provide an improved door lock structure which substantially overcomes all of the above-mentioned disadvantages of prior art closures.

Another feature of the present invention is to provide a door lock structure for an accordion-type folding door and wherein the lock structure comprises a pair of axially aligned locking bolts disposed in a door edge post for engagement in the ceiling and floor.

Another feature of the present invention is to provide a door lock structure wherein the locking rods are manually placed in their lock position from either side of the locking post and are released by a key-operated cylinder lock which may be provided on one or both sides of the door edge post.

According to the above features, from a broad aspect, the present invention provides a door lock structure for securement in a longitudinal cavity in a door vertical free edge portion or a folding door edge post. The door lock structure comprises an elongated locking rod supportingly guided in the longitudinal cavity. Each rod has a locking free end which is extendible above an open end of the bore above a horizontal edge of a door. The rod is manually biased in a retracted position in the cavity, with the rod locking free end disposed inwardly of the horizontal door edge. External rod displacement means is secured to the rod for displacing the rod and the locking free end outwardly of the longitudinal door edge to a locked position. Bolt engaging means is disposed inwardly of the door edge adjacent the rod for engaging the rod when placed in its locking position.

BRIEF DESCRIPTION OF DRAWINGS

A preferred embodiment of the present invention will now be described with reference to an example thereof as illustrated in the accompanying drawings, in which.

DESCRIPTION OF PREFERRED EMBODIMENTS

Figure 1:
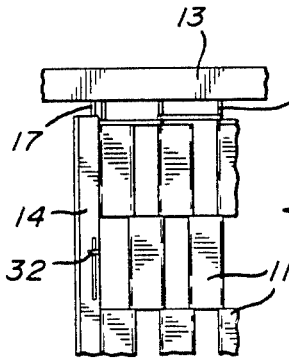
FIG. 1 is a fragmented front view of an accordion-type closure screen embodying the door lock structure of the present invention.

Referring now to FIG. 1, there is shown generally at 10, a door structure or door screen 10 which comprises a plurality of folding door panels 11 hinged together by hinge pins 12 and slidingly supported in a ceiling track 13.

Figure 4:
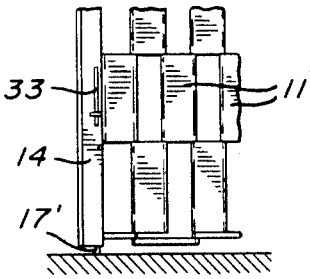
FIG. 4 is a fragmented front view illustrating the bolt retracting mechanism.
Figure 4:
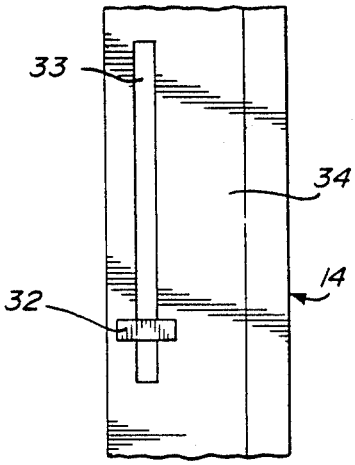
Figure 2:
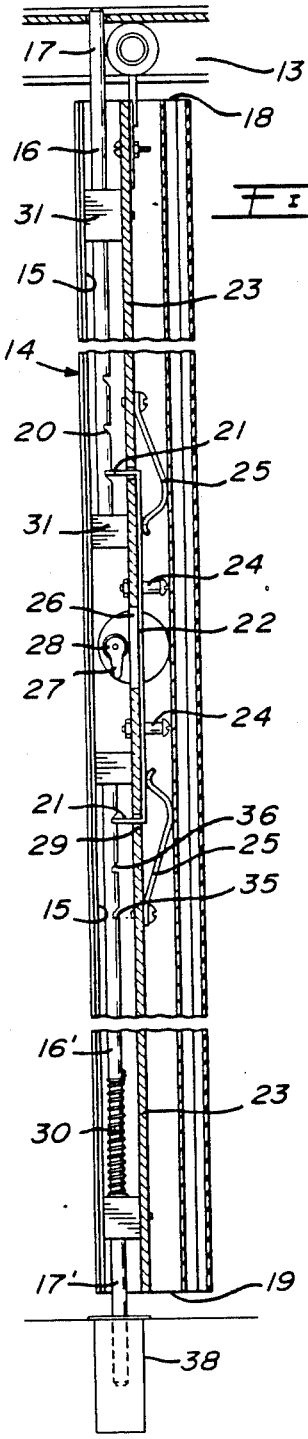
FIG. 2 is a fragmented section view of the door edge post illustrating the door lock structure of the present invention in its locked position.
Figure 3:
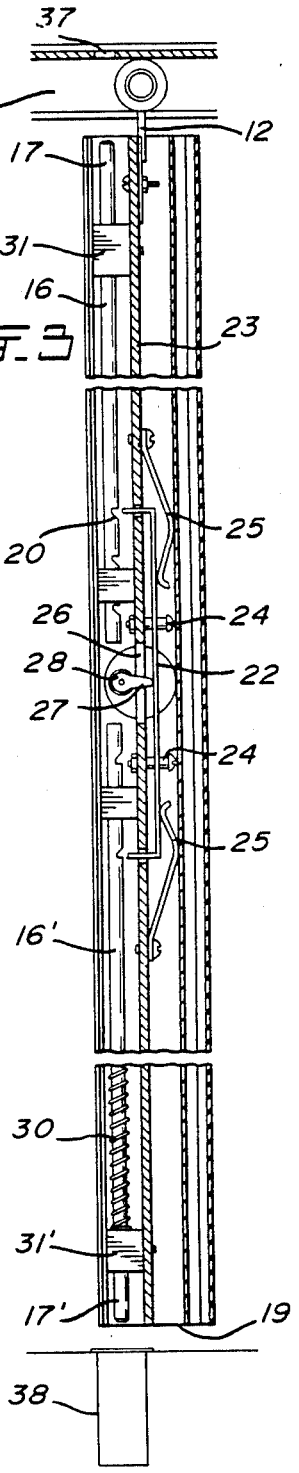
FIG. 3 is the same as FIG. 2 but illustrating the door lock structure of the present invention in its retracted position.

Referring now to FIGS. 2 to 4, it can be seen that the door edge post 14 is a hollow post defining therein longitudinal cavities 15 in which the door lock structure of the present invention is mounted.

The door lock structure of the present invention comprises an elongated locking rod 16 and 16' mounted respectively in the longitudinal cavity 15 in opposed end portions of the edge post 14. Each rod has a locking free end portion 17 which is movable above an open end of the longitudinal cavity 15 in the top horizontal edge 18 and bottom horizontal edge 19 of the door edge post 14, respectively.

As hereinshown, each of the locking rods 16 and 16' are provided with one or more retention notches 20 whereby to receive therein a bolt engaging means which is constituted by an arresting finger 21 formed at the respective ends of an elongated lock arm 22. The lock arm is a metal plate having a flat elongated section and right-angled end sections constituting the arresting fingers. A support wall 23 is secured in the door edge post 17 and extends parallel to the locking rods. Guide means in the form of a pair of spaced-apart guide pins 24 permits displacement of the lock arm 22 and securement thereof with respect to the support wall 23. The lock arm 22 is also spring-biased against the support wall 23 by a pair of compression leaf springs 25.

The support wall 23 is also provided with a central opening 26 to permit passage of a cam finger member 27 when rotated by the key-operated cam cylinder 28. The support wall 23 is also provided with guide apertures 29 for passage of the arresting fingers 21 of the lock arm 22. When the key-operated cam cylinder 28 is rotated, the cam finger moves in the direction of the lock arm 22 whereby to push the lock arm away from the support wall, as shown in FIG. 3. When in this position, the arresting fingers 21 move out of their respective engagement with the notches 20 in their respective locking rods 16 and 16' whereby to cause the rods to retract within the door edge post 14.

As is shown in FIGS. 2 and 3, the bottom locking rod 16' is secured to a recoil spring 30 which is disposed inwardly in the longitudinal cavity 15 and coiled about the bolt 16' to spring bias the bottom locking bolt inwardly into its longitudinal cavity, as shown in FIG. 3. The top or upper locking bolt 16 is retracted inwardly by its own weight. Both bolts are guided in guide bushings 31 to assure smooth and quiet sliding displacement of the bolts within the door edge post 14. These may, for example, by nylon-type guide bushings. The bottom guide bushing 31' is also utilized to arrest the bottom portion of the recoil spring 30.

Referring now to FIG. 4, there is shown an external rod displacement means in the form of a hand gripping knob 33 which is secured to a respective one of the locking bolts 16 and 16' and movable along a longitudinal slot 33 provided on the outside wall 34 of the door edge post 14. With both bolts in their retracted position, this knob is located adjacent an end of its respective slot. The knob 33 also limits the travel distance of the bolts in and out of their cavities. In order to move the bolts outwardly of the top and bottom horizontal edge of the post, it is necessary to move the hand-gripping knob 32 in a direction towards the end of the post. The key has been removed from the lock cylinder with the cam member positioned as in FIG. 2 whereby the fingers 21 of the lock arm are spring-biased against the rods 16 and 16' to engage in the notches 20 when the bolts are moved to their locking position. As the locking rod moves out of the top or bottom edge of the door post, the arresting finger 21 of the lock arm 22 engages within the notches and retains the bolt in an extended locking position. As shown in FIGS. 2 and 3, each notch has an arresting straight edge 35 and a sloped edge 36. The straight edge prevents inward displacement of the bolt in its longitudinal cavity when the arresting finger 21 is located in one of the notches. The sloped edge permits outward movement of the bolt from its longitudinal cavity with the arresting finger sliding on the sloped edge of the notches.

Figure 5:
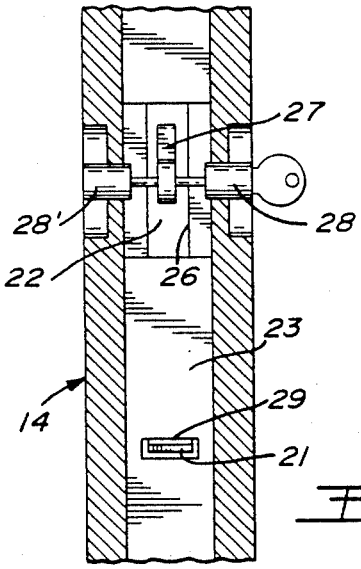
FIG. 5 is a fragmented section view illustrating the lock bolt disengaging cylinder and its position relative to the lock arm.

As previously described, the door closure as shown in FIG. 1 is an accordion-type door closure having a plurality of hinged panel strips interconnected to one another by vertical pins (not shown) and supported by ceiling track 13. This track 13 is also provided with a bolt-receiving cavity 37 to receive the locking free end portion 17 of the upper lock bolt 16. The bottom locking bolt free end portion 17' is received in a floor socket 38 whereby the post is locked solidly by an elongated steel rod extending out of its top edge 18 and bottom edge 19. The key-operated cam cylinder 28 as well as the external rod displacement means in the form of the hand-gripping knob 32 are all located on the outside wall 34 of the door or post whereby the door or post may be locked when one exits the premises that it protects. However, the door or edge post 14 may also be provided with a locking bolt activating mechanism on the inside face of the post. That is to say, the inside face would also have a hand-gripping knob 32 as well as a key-operated or hand-operated cylinder 28 whereby to lock and unlock the door edge post from both sides. For this purpose, the additional cylinder 28', as shown in FIG. 5, would also be coupled to the cam finger member 27 by suitable coupling means, not shown herein, but well known to a person skilled in the art.

Although the particular door lock structure as hereinshown has been described with respect to its securement in a door edge post of an accordion-type door, this door lock structure can also be provided in the free edge of any door including folding doors. Further, although a pair of compression leaf springs 25 have been shown for biasing the lock arm 22 towards its lock position, a single leaf spring or coil spring(s) could be utilized to effect this biasing. Other obvious modifications of the example of the preferred embodiment described herein are intended to be covered by the present specification, provided such modifications fall within the scope of the broad claim as contained herein.

I claim:

1. A door lock structure for securement in a longitudinal cavity in a door vertical free edge portion or folding door edge post, said door lock structure comprising an elongated locking rod supportingly guided in said longitudinal cavity, said rod having a locking free end movable above an open end of said bore above a horizontal edge of said door, said rod being normally biased in a retracted position in said cavity with said rod locking free end disposed inwardly of said horizontal door edge, external rod displacement means on an outside face of said door vertical free edge portion and secured to said rod for displacing said rod and said locking free end outwardly of said horizontal door edge to a locking position, bolt engaging means disposed inwardly of said door edge adjacent said rod for engaging said rod when placed in its locking position, key operated cam means accessible from an outside face of said door vertical free edge portion for disengaging said rod engaging means from engagement with rod, there being two of said longitudinal cavities axially aligned in said door edge, a locking rod associated with each said cavity and each biased with their respective locking free end inwardly of a top and bottom horizontal edge of said door, said bolt engaging means engaging both said bolts simultaneously in their locking position and permitting either of said bolts to be independently displaced to their locking position, each said bolt being provided with at least one retention notch therein, said bolt engaging means being an elongated lock arm having an arresting finger at opposed ends thereof, said lock arm being spring biased in the direction of said bolts with said arresting fingers contacting an associated one of said bolts whereby said fingers will enter said retention notch when displaced thereagainst.

2. A door lock structure as claimed in claim 1, wherein said key operated cam means comprises a cylinder cam having a cam finger member pivotally secured on an eccentric pivot whereby rotation of said cam shaped shoulder member pushes said lock arm against its spring bias to displace said fingers away from their respective bolts.

3. A door lock structure as claimed in claim 2, wherein said lock arm is a flat metal bar having an elongated straight wall and right angle end portions constituting said arresting fingers, a support wall secured parallel to said locking rods, one or more compression springs secured for compression by said displacement of said lock arm by said cam means, and guide means for retaining said flat metal bar in position with respect to said support wall and associated locking pins.

4. A door lock structure as claimed in claim 3, wherein said guide means is a pair of spaced-apart guide pins secured to said support wall and extending through an associated slot in said flat metal bar, said compression springs being a pair of spaced spring-metal strips configured to apply spring pressure and being captive between said flat metal bar and a stationary wall member outwardly spaced from said metal bar.

5. A door lock structure as claimed in claim 2, wherein each said locking rod is provided with two or more of said retention notches, each said notches having an arresting straight edge and a sloped edge, said straight edge preventing inward displacement of said bolt in its longitudinal cavity when said arresting finger is located in one of said notches, said sloped edge permitting outward movement of said bolt from its longitudinal cavity with said arresting finger sliding on said sloped edge of said notches.

6. A door lock structure as claimed in claim 2, wherein said bottom one of said locking bolts is secured to a recoil spring disposed inwardly in said longitudinal cavity and coiled about said bolt to spring bias said bottom locking bolt inwardly into its longitudinal cavity with said locking free end retracted inwardly of said door lower edge.

7. A door lock structure as claimed in claim 6, wherein said upper one of said locking bolts is gravity biased inwardly in its longitudinal cavity by its own weight; said locking free end of said upper locking bolt, when extended, being received in a support track locking cavity while said locking free end of said lower bolt is received in a floor socket when extended.

8. A door lock structure as claimed in claim 7, wherein each said locking rods extend through guide bushings secured inwardly in said door vertical free edge.

9. A door lock structure as claimed in claim 8, wherein said door vertical free edge is an elongated free edge portion of a locking post secured to an accordion-type door closure having a plurality of hinged panels interconnected to one another by vertical pivot pins and supported by a ceiling track.

10. A door lock structure as claimed in claim 8, wherein said door vertical free edge is an elongated free edge portion of a folding door.

11. A door lock structure as claimed in claim 2, wherein said external rod displacement means is a hand-gripping knob secured to a respective one of said locking rods and extend through a longitudinally aligned slot provided in said outside and an inside wall of said door vertical free edge.

12. A door lock structure as claimed in claim 2, wherein said cylinder cam is rotatable on said eccentric axis by a key insertable in a key slot provided in a key cylinder on said outside wall of said door vertical free edge and a further key cylinder secured on an inside wall of said door vertical free edge, and connections for connecting both key cylinders to said cam for independent operation.

* * * * *